United States Patent [19]

Gardner

[11] 4,279,375

[45] Jul. 21, 1981

[54] SHIPPING-DISPLAY CONTAINER

[75] Inventor: Jeffrey M. Gardner, Wheaton, Ill.

[73] Assignee: Container Corporation of America, Chicago, Ill.

[21] Appl. No.: 120,358

[22] Filed: Feb. 11, 1980

[51] Int. Cl.[3] ..... B65D 5/02

[52] U.S. Cl. ..... 229/37 R; 248/174

[58] Field of Search ..... 229/37; 248/174; 211/132

[56] References Cited

U.S. PATENT DOCUMENTS

| | | | |
|---|---|---|---|
| 1,896,721 | 2/1933 | Richards | 229/37 R X |
| 1,916,647 | 7/1933 | Walker | 248/174 |
| 1,947,195 | 2/1934 | Flynn | 248/174 X |
| 2,097,647 | 11/1937 | Scott | 229/37 R X |
| 2,113,481 | 4/1938 | Kasdorf | 229/37 R |
| 2,926,777 | 3/1960 | Maguire | 229/37 R X |
| 3,029,997 | 4/1962 | Kauffeld | 229/37 R |
| 3,032,253 | 5/1962 | Younger | 229/37 R |

*Primary Examiner*—Davis T. Moorhead

*Attorney, Agent, or Firm*—R. W. Carpenter; Davis Chin

[57] ABSTRACT

A collapsible container formed of paperboard which can be folded one way for shipping purposes and an alternate way for display purposes.

2 Claims, 7 Drawing Figures

SHIPPING-DISPLAY CONTAINER

SUMMARY OF THE INVENTION

This invention relates to paperboard containers and more particularly to containers which are adapted to be used for both shipping and display.

It is an object of the invention to provide a container of the type described which has a plurality of fold lines in certain of the panels which will permit the structure to be folded in one way to provide a shipping container and to be folded in an alternate way to provide a display container.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

DESCRIPTION OF THE INVENTION

Figure 1:
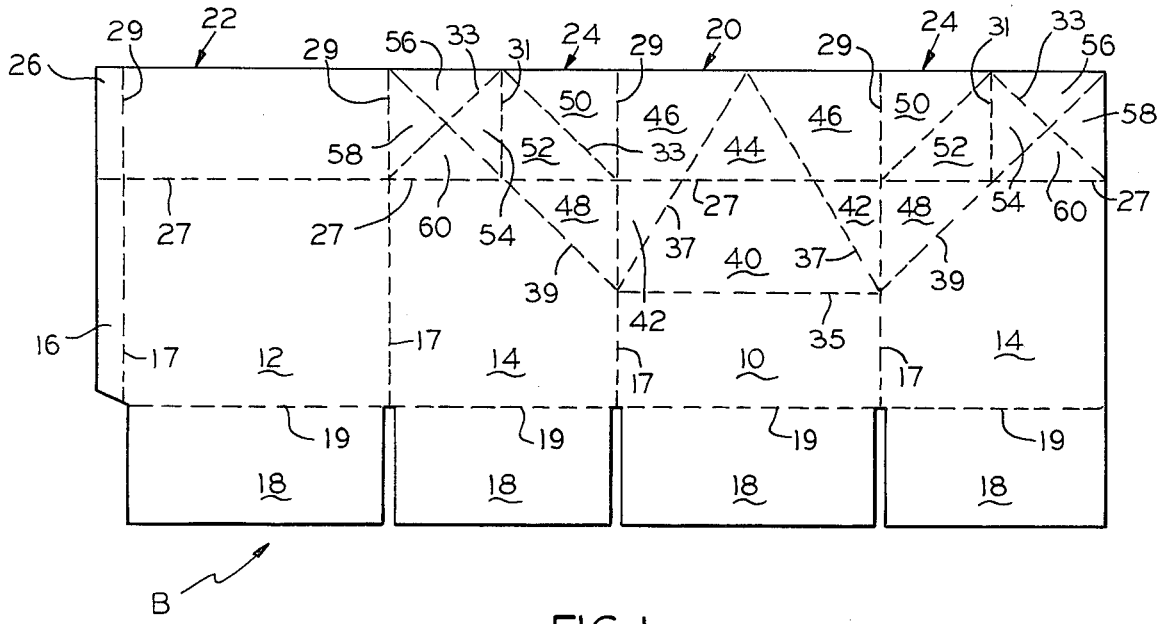
FIG. 1 is a plan view of a blank of sheet material from which the structure illustrated in the other views may be formed.
Figure 2:
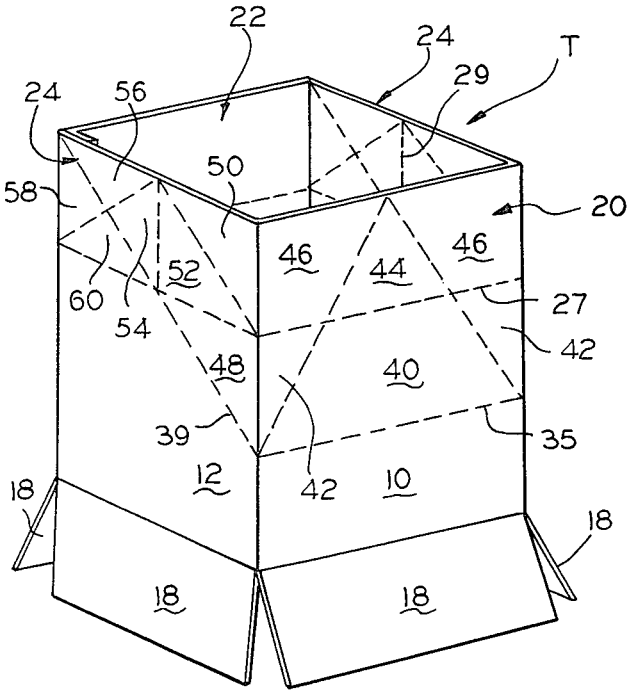
FIG. 2 is a perspective view of the structure in a partially erected position.
Figure 4:
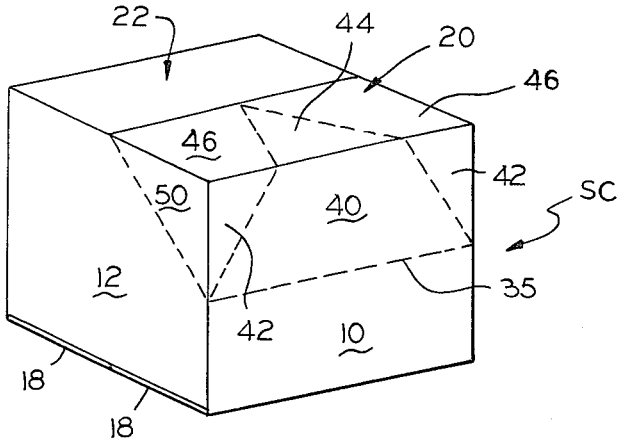
FIG. 4 is a perspective view of a shipping container embodying features of the invention.
Figure 5:
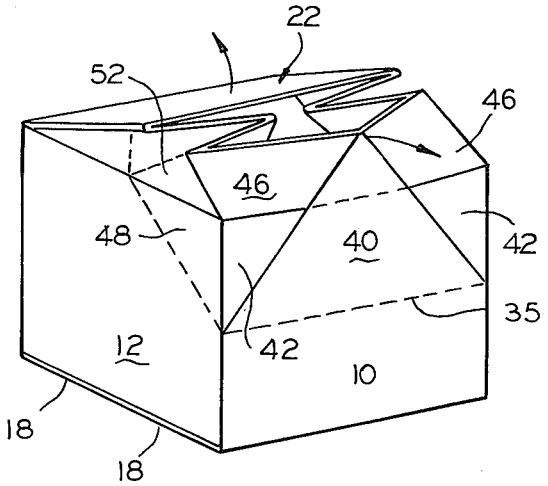
FIGS. 5 and 6 are perspective views illustrating the manner in which the structure of FIG. 2 is folded into a display container, as illustrated in FIG. 7.
Figure 6:
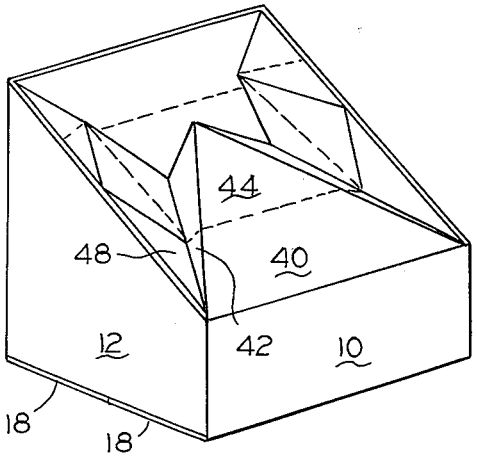
Figure 7:
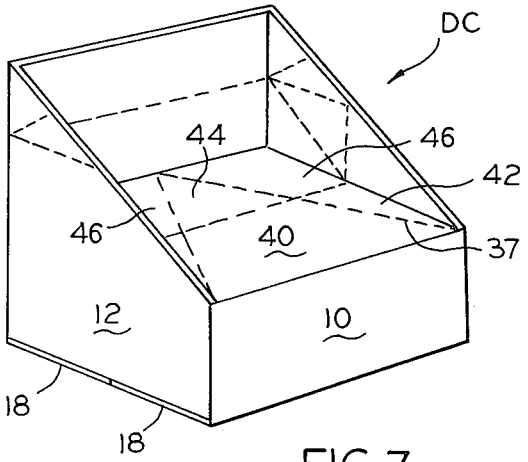
FIG. 7 is a perspective view of a display container embodying features of the invention.

Referring now to the drawings for a better understanding of the invention, it will be seen that the basic structure T illustrated in FIG. 2 and formed from a unitary blank B of foldable paperboard illustrated in FIG. 1, may be either folded into the form of a closed shipping container SC as illustrated in FIG. 4, or may be alternately folded into the form of a display container DC as illustrated in FIG. 7.

As best seen in FIGS. 1 and 2, the structure includes a body portion having a front wall 10 and a rear wall 12 which are interconnected by a pair of side walls 14 and a glue strip 16, all of which are foldably joined to each other in side by side relation along fold lines 17 to form the tubular structure T illustrated in FIG. 2.

The lower end of the structure may be provided with a plurality of bottom closure flaps 18 foldably joined to front, rear and side walls 10, 12 and 14 along fold lines 19. The flaps may be folded and secured in overlapped relation in a conventional manner.

The novel portion of the invention relates to the closure arrangement for the upper end of the container and includes front, rear and side closure flaps 20, 22 and 24, respectively, and an extension 26 of glue strip 16, all of which are foldably joined to related walls of the body along aligned fold lines 27 and which are foldably joined to each other along fold lines 29 which are aligned with the fold lines which join the body walls and glue strip to each other.

The invention includes the provision of a plurality of fold lines in certain of the walls and flaps, as hereinafter described, which enable the structure to be folded either into the form of the shipping container SC or the display container DC.

Each side closure flap includes a fold line 31 which extends from fold line 27 to the opposite edge of the flap and which is located midway between and parallel to related fold lines 29. Flap 24 also includes a pair of upwardly converging fold lines 33 which extend diagonally from the lower corners of the flap to the point where fold line 31 intersects the free edge of the flap.

Front wall 10 includes a transverse fold line which extends across the wall between related fold lines 17 and which is located between and parallel to related fold lines 19 and 27. Wall 10 also includes a pair of upwardly converging fold lines 37 which extend from the intersections of fold lines 35 and 17 upwardly through front closure flap 20 to the approximate midpoint of the free edge of flap 20.

Each side wall 14 includes a fold line 39 which extends from the intersection of fold lines 35 and 17 diagonally upward and rearward through related side closure flap 24 to the upper rear corner of flap 24.

The previously described fold lines in combination with each other and with earlier described fold lines 17, 27 and 29 form a plurality of panels in the front and side walls and closure flaps.

Front wall includes panels 40 and 42; side walls 14 each include a panel 48; front closure flap 20 includes panels 44 and 46; and each side closure flap 24 includes panels 50, 52, 54, 56, 58 and 60.

Figure 3:
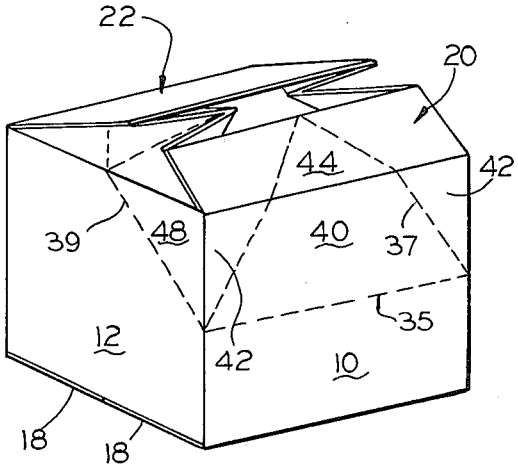
FIG. 3 is a perspective view illustrating the manner in which the structure of FIG. 2 is folded into a shipping container, as illustrated in FIG. 4.

When it is desired to convert the structure T of FIG. 2 to a shipping container SC of FIG. 4 with a bellows closure arrangement, the side closure flaps 24 are folded on lines 33 and 33, as shown in FIG. 3, so that panels 50, 56–58, and 52-54-60 form the bellows arrangement.

When it is desired to convert the structure T of FIG. 2 to a display structure DC of FIG. 7, side walls and side closure flaps 14 and 24 are folded on fold lines 39 and front wall 10 is folded on fold line 35 to provide a chair shaped display structure.

Although the structures are not finally folded on lines 31 or 37, the structure can be folded on these lines as an intermediate step in either folding sequence.

Thus, it will be understood that the novel structure of the invention lends itself to be used for two different purposes, shipping or displaying, and can be readily changed from one form to the other by utilizing the unique fold line arrangement to accomplish this purpose.

I claim:

1. A collapsible container, formed of foldable paperboard, which can be folded in one way to provide a closed structure for shipping purposes and which can be alternately folded in another way to provide an open structure for display purposes, comprising:

(a) a pair of opposed front and rear walls and a pair of side walls foldably joined to form a tubular structure open at the ends;

(b) means for closing the lower end of the container;

(c) front, rear, and side closure flaps foldably joined to upper edges of said front, rear, and side walls, respectively, and adapted to be folded into overlapped relation to provide a closure arrangement for the upper end of the container;

(d) said closure flaps foldably joined to each other with said side closure flaps including fold lines which permit the closure flaps to be folded into a bellows type closure arrangement;

(e) said front and side walls and the closure flaps joined thereto including additional fold lines which permit the upper portion to be alternately folded into a chair-shaped shelf arrangement; and (f) said additional fold lines including:

(i) a fold line extending transversely across said front wall between the sides thereof intermediate and parallel to the upper and lower edges of said front wall; and (ii) a fold line in each side wall and side closure flap extending diagonally upward and rearward from said transverse fold line to the rear upper corner of said side closure flap.

2. A container according to claim 1, and including a pair of fold lines in said front wall and front closure flap extending upward and inward from the ends of said transverse fold line to the upper edge of said front closure flap.

* * * * *